United States Patent [19]

Albien et al.

[11] Patent Number: 4,818,594

[45] Date of Patent: Apr. 4, 1989

[54] CONSOLIDATED NONWOVEN FABRICS AND PROCESS FOR PRODUCING THEM

[75] Inventors: Klaus Albien, Denzlingen; Günter Maurer, Neuenburg, both of Fed. Rep. of Germany

[73] Assignee: Rhodia AG, Freiburg, Fed. Rep. of Germany

[21] Appl. No.: 91,840

[22] Filed: Sep. 1, 1987

[30] Foreign Application Priority Data

Sep. 6, 1986 [DE] Fed. Rep. of Germany ..... 3630392

[51] Int. Cl.[4] ..... D03D 3/00

[52] U.S. Cl. ..... 428/224; 15/104.93; 264/129; 264/518; 428/288; 428/297; 428/299; 428/913

[58] Field of Search ..... 428/224, 297, 299, 301, 428/913, 288, 290, 296; 28/104; 264/129, 518; 156/167; 8/DIG. 4; 210/508; 15/104.93

[56] References Cited

U.S. PATENT DOCUMENTS

| | | | |
|---|---|---|---|
| 4,307,143 | 12/1981 | Meitner | 428/903 |
| 4,328,279 | 5/1982 | Meitner et al. | 428/903 |
| 4,656,081 | 4/1987 | Ando et al. | 28/104 |

FOREIGN PATENT DOCUMENTS

| | | |
|---|---|---|
| 1032301 | 6/1978 | Canada . |
| 1097046 | 10/1981 | Canada . |
| 2845551 | 8/1980 | Fed. Rep. of Germany . |

*Primary Examiner*—James J. Bell
*Attorney, Agent, or Firm*—Felfe & Lynch

[57] ABSTRACT

Consolidated nonwoven fabrics and the process of producing theme is disclosed. The fabrics absorb water and substances with oleophilic and/or lipophilic properties. The inventive process includes blow-spinning a melt or a solution of a spinnable polymeric material to textile fibers and/or filaments, preferably having a diameter of 0.1 to 6 μm, more preferably 0.5 to 3 μm, transforming these textile fibers and/or filaments to a nonwoven fabric, consolidating this fabric and applying a wetting agent to the fabric. Consolidation is accomplished by means of water jets, then a zwitterionic or cationic surfactant is applied to the fabric in a wet-in-wet procedure during or immediately after the water-jet consolidation, and the fabric is dried; these procedures are performed continuously. A polyester or a polyamide is used preferentially as the polymeric material.

9 Claims, No Drawings

CONSOLIDATED NONWOVEN FABRICS AND PROCESS FOR PRODUCING THEM

FIELD OF THE INVENTION

The invention relates to a process for producing consolidated nonwoven fabrics for the absorption of water and/or substances with oleophilic and/or lipophilic properties by blow-spinning a melt or a solution of a spinnable polymeric material by means of a spinneret, having one or more nozzle orifices, to form textile fibers and/or filaments, converting these textile fibers and/or filaments to a nonwoven fabric by depositing them on a receiving means, consolidating this nonwoven fabric, and applying a wetting agent to the nonwoven fabric. The invention also relates to the consolidated nonwoven fabrics for the absorption of water and/or substances with oleophilic and/or lipophilic properties made by the inventive process.

BACKGROUND OF THE INVENTION

It is known to produce consolidated nonwoven fabrics for the absorption of water and/or oil by blow-spinning molten polypropylene to form fiber webs whose fibers have an average diameter of up to 10μm, pattern-binding the fiber webs with pins, and spraying an anionic or nonionic surface-active substance onto the fiber webs as described in German Patent No. DE 28 45 551.

The known nonwoven fabrics of this kind, however, have the following disadvantages:

- Pattern-binding with pins considerably reduces the surface of the nonwovens that is active in the absorption of water and/or oil.
- Since pattern-binding with pins cannot be performed on the entire surface area, since otherwise the fabric surface active in the absorption of water and/or oil is completely lost, such partially pattern-bound nonwovens have but relatively low strengths, such as maximum tensile strength, initial tearing resistance and tear growth resistance, as well as a relatively high raveling loss (i.e., abrasion).
- The pattern-binding cannot change the original bidimensional arrangement of the fibers in the fabric, i.e., the arrangement of the fibers in the lengthwise and transverse directions. Consequently, not only is no improvement of the fabrics possible in regard to the textile drape and feel and the softness, but a decided impairment occurs in this regard.

The invention is addressed to the problem of creating a process of the kind described above, whereby nonwoven fabrics can be obtained, which

- will have a greater effective surface area than known nonwovens of this kind for the absorption of water and/or oils, fats and the like,
- will have improved strengths, such as improved maximum tensile strength, improved initial tearing resistance and improved tear growth resistance, as well as a lesser raveling loss (i.e., abrasion), in comparison to the known nonwovens of this kind, and
- will have a better textile drape, feel and improved softness, in comparison to the known nonwovens of this kind.

SUMMARY OF THE INVENTION

This problem is solved according to the inventive process by producing consolidated nonwoven fabrics by blow-spinning a melt or a solution of a spinnable polymeric materials by a spinneret means having one or a plurality of nozzle orifices to form textile fibers and/or filaments having a diameter of 0.1 to 6 μm, preferably 0.5 to 3μm. These fibers and filaments are then transformed into a nonwoven fabric by spun depositing them on a receiving means. The nonwoven fabric is consolidated by means of water jets, and during or immediately after this water-jet consolidation a zwitterionic or cationic surfactant is applied as a wetting agent in a wet-in-wet procedure and the nonwoven fabric is subsequently dried.

Spinnable polymeric materials preferably employed in the process are polyesters or polyamides and most preferably polyethylene terephthalate is the polyester used and the polyamide used is polyamide-66 (i.e., polyhexamethyleneadipamide).

Wetting agents preferably employed include 1-alkoylamino-3-dimethylamino-propane-3-N-oxide, cocamidopropyl-betaine, or 1-alkoylamino-3-dimethylammoniopropane-3-carboxymethylbetaine, and alkyl-dimethyl-benzylammonium chlorides are used.

Polyesters and polyamides are preferably used in the inventive process as spinnable polymeric materials because:

- The nonwoven fabrics obtained can be dried at high temperatures, e.g., decidedly above 150° C, and are usable even at such high temperatures for the absorption of water and substances with oleophilic and/or lipophilic properties, and
- The nonwoven fabrics obtained have very high strengths, especially a high maximum tensile strength, initial tearing resistance and tear growth resistance.

The textile fibers and/or filaments obtained in the process preferably have a diameter of 0.5 to 3μm because this fineness of the textile fibers and filaments, i.e., on account of their small diameter and thus great specific surface area, produce nonwovens having a very large active surface for the absorption of water and/or substances with oleophilic and/or lipophilic properties.

The preferred wetting agents, namely, 1-alkoylamino-3-dimethylamino-propane-3-N-oxide, cocamidopropyl-betaine, or 1-alkoylamino-3-dimethylammonio-propane-3-carboxymethylbetaine address special problems, for example in the treatment of metals, where anticorrosive protection and rapid drying are important.

The other preferred wetting agents, namely, alkyl-dimethyl-benryl-ammonium chlorides, offer the advantage that they are biodegradable and tolerant (harmless) to the skin.

It is also the object of the invention to make available consolidated nonwoven fabrics of the kind described, which

- in comparison to the known nonwovens of this kind, have a larger active area for the absorption of water and/or oils, fats and the like,
- in comparison to the known nonwovens of this kind, have improved strength characteristics, such as improved maximum tensile strength, initial tearing resistance and tear growth resistance, as well as reduced raveling loss (abrasion), and
- in comparison to the known nonwovens of this kind, have a better textile drape, feel and an improved softness.

This problem is addressed according to the invention, in that the consolidated nonwoven fabrics referred to above are produced by the inventive method described in more detail below.

DETAILED DESCRIPTION OF THE PREFERRED EMBODIMENTS

For the purposes of the invention, although any materials known in the art which can be fabricated by melt spinning or solution spinning (dry spinning) can be used in the inventive process, it is preferable that polyesters such as polyethylene terephthalate, polyamides such as polyamide-66, polyolefins such as polyethylene and polypropylene, cellulose esters such as cellulose-2,5-acetate and -triacetate, and acrylic polymers such as polyacrylonitrile are used.

By the process according to the invention, a melt or a solution of a spinnable polymeric material is blow-spun to form textile fibers and/or filaments. Blow spinning employed in this inventive process is described, for example, in "Industrial and Engineering Chemistry", vol. 48, No. 8 (1956), pages 1342 to 1346, and in German Pat. No. 19 64 060, which are herein incorporated by reference.

Substances with oleophilic and/or lipophilic properties which are absorbable by the inventive nonwoven fabrics include, for example, oils, such as mineral oils or silicone oils, and fats or their mixtures.

According to the invention, the consolidation of the nonwoven fabric is performed by water jets. A preferred water jet consolidation method is described in German Offenlegungsschrift 17 10 989 and in German Auslegeschrift 16 35 577, herein incorporated by reference.

Water-jet consolidation entangles and post-stretches the spun fibers and/or filaments within the nonwoven fabric producing additional active surface for the absorption of water and/or substances with oleophilic and/or lipophilic properties, improving strength properties of the nonwoven fabric while at the same time reducing raveling loss (abrasion) and improving textile drape, feel and softness in the final form of the fabric.

According to the invention, a zwitterionic or cationic surfactant is placed on the fabric as a wetting agent. Preferable zwitterionic surfactants are aminoxides and betaines, as well as imidazoline carboxylates and aminocarboxylic acids. Cationic surfactants which are preferably employed are, for example, primary, secondary, tertiary or quaternary ammonium salts, benzylammonium salts, alkanolammonium salts, pyridinium salts, imidazolinium salts, oxazolinium salts, thiazolinium salts, sulfonium salts, quinolinium salts, salts of aminoxides, tropylium salts, and isoquinolinium salts or mixtures thereof.

The nonwoven fabrics according to the invention can be used as roll goods or cut in measured pieces for cleaning purposes in industrial or nonindustrial applications; it is important that both water and substances with oleophilic and/or lipophilic properties can be absorbed by the nonwoven fabrics.

It will be understood that the specification and examples are illustrative but not limitative of the present invention and that other embodiments within the spirit and scope of the invention will suggest themselves to those skilled in the art.

EXAMPLE 1

Polyethylene terephthalate with an intrinsic viscosity of 0.67 (measured in tetrachloroethane-phenol 1:1), a melt viscosity of 2,400 dPa.s and a moisture content of 0.1 weight-percent was melted at 323° C. and melt-blow-spun by means of a spinning head (spinneret) similar to the one according to German Patent 25 50 463 to form textile fibers and filaments having an average diameter of 1.8 $\mu$m. The textile fibers and filaments were made into a nonwoven fabric with a basis weight of 100 g/m$^2$ by deposition onto a receiving means which consisted of a rotating drum. The spinneret was situated above the rotating drum and the spinning was performed vertically downwardly.

The nonwoven fabric, which had a width of 200 mm was guided over rollers onto a circulating endless screen belt which was part of a water jet consolidating apparatus based on the principle of the one described in German Auslegeschrift No. 16 35 577.

The water jet consolidating apparatus had eight rows of water jets disposed above the fabric at an angle of 90° to the direction of movement of the fabric. Each row of water jets had a length (effective jet width) of 200 mm and had 100 nozzle holes. The distance of the nozzles from the fabric was 10 mm and a water pressure of 120 bar prevailed ahead of each nozzle. The water jets formed an angle of 90° with the fabric.

By then passing the fabric through wringer rolls the process water was removed down to a residual moisture content of 100% in the fabric.

This was immediately followed by the application of the wetting agent by passing the fabric over a patterned wetting roll. The wetting agent was 1-alkoylamino-3-dimethylaminopropane-3-N-oxide. The liquid absorption of the fabric amounted to 100% of the initial dry weight of this fabric. The bath of the wetting agent had a concentration of 0.5 weight-percent of the above-named wetting agent; the fabric thus received a content of 0.5 weight-percent of wetting agent, with respect to the dry weight of the fabric.

From the wetting roll, the fabric was carried through a drying oven where it was dried down to a residual moisture content of about 1% and then wound on tubes.

The process speed, i.e., the speed with which the fabric ran continuously through the above-described steps, amounted to 2 meters per minute. The consolidated fabric obtained had a maximum tensile strength (measured according to DIN 53857) in the lengthwise direction of 8.3 daN and of 4.5 daN in the transverse direction.

The specific textile fiber and filament surface area of this fabric that was active for the absorption of water and/or oils and/or fats and the like amounted to 1.6m$^2$/g (measured by the BET method), corresponding to 160 m$^2$ of surface per square meter of fabric. The oil absorption of this fabric (measured according to the oil binder guideline of the Federal Ministry of the Interior in the text of 31 December 1985) amounted to 4.3 grams of oil per gram of fabric.

The ability of this fabric to absorb water (measured by adapting the oil binder guideline mentioned above) amounted to 5.8 g of water per gram of fabric. Furthermore, the consolidated fabric obtained had a pleasant, soft textile feel and good draping quality.

EXAMPLE 2

Example 1 was repeated except that the application of the wetting agent was performed not by guiding the fabric over a patterned wetting roll but by applying to the fabric this agent, contained in an 0.3 weight-percent solution in the process water, through the water-jet consolidating apparatus, Instead of the wetting agent named in Example 1, a mixture of alkyl-dimethylbenzylammonium chlorides was used, which is sold by Hoechst AG, Frankfurt-on-the-Main, Federal Republic of Germany, under the trademark DODIGEN 226, The process water was removed after the water-jet consolidation by passing the fabric through wringer rolls to a residual moisture content in the fabric of 200%, the fabric thus receiving a content of 0.6 weight-percent of wetting agent, with respect to the dry weight of the fabric, Immediately after removal of the process water the fabric was dried by passing it through a drying oven down to a residual moisture content of about 1%.

In the rest of its properties the consolidated fabric obtained was the same as the fabric of Example 1.

The invention has the following advantages:

The consolidated nonwoven fabrics produced according to the invention have a greater active surface for the absorption of water and/or oils, fats and the like, improved strength characteristics and less loss by raveling (abrasion), and a better textile drape and feel and improved softness in comparison to known consolidated nonwoven fabrics for the absorption of water and substances with oleophilic and/or lipophilic properties.

What is claimed is:

1. A consolidated nonwoven water and oil wipe fabric prepared by a continuous process comprising the steps of:

(a) forming a melt or a solution of a spinnable polymeric material;

(b) blow-spinning said spinnable polymrric material through a spinneret means having at least one nozzle orifice to form textile fibrous elements having a diameter in the range of 0.1 to 6 μm;

(c) depositing said textile fibrous elements on a receiving means;

(d) consolidating said textile fibrous elements no said receiving means by a water-jet means to form a consolidated nonwoven fabric;

(e) concurrently or subsequently applying a zwitterionic or cationic surfactant agent to the consolidated nonwoven fabric in a wet-in-wet procedure; and (f) drying the thus treated consolidated nonwoven fabric.

2. A nonwoven water and oil wipe fabric of claim 1, where said spinnable polymeric material in step (a) is a polyester or polyamide.

3. A nonwoven water and oil wipe fabric of claim 2, where said polyester in polyethylene terephthalate and said polyamifde is polyamide - 66.

4. A nonwoven water and oil wipe fabric of claim 1, where said textile fibrous elements in steps (a) and (b) have a diameter in the range of 0.5 to 3 μm.

5. A nonwoven water and oil wipe fabric of claim 1, where said surfactant agent in step (e) is selected from the group consisting of aminoxides, betaines, imidazoline carboxylates, aminocarboxylic acids, primary ammonium salts, secondary ammonium salts, tertiary ammonium salts, quaternary ammonium salts, benzylammonium salts, alkanolammonium salts, pyridinium salts, imidazolinium salts, oxanolinium salts, thianolinium salts, sulfonium salts, quinolinium salts, salts of aminoxides, tropylium salts, isoquinolinium salts, and mixtures thereof.

6. A nonwoven water and oil wipe fabric of claim 5, where said surfactant agent is 1-alkoylamino-3-dimethylaminopropane-3-N-oxide, cocamidopropyl-betaine or 1-alkoylamino-3-dimethylammonio-propane-3-carboxymethylbetaine.

7. A nonwoven water and oil wipe fabric of claim 5, where said surfactant agent is an alkyl-dimethyl-benzylammonium chloride.

8. A nonwoven water and oil wipe fabric of claim 1, where step (e) is performed concurrently with step (d).

9. A nonwoven water and oil wipe fabric of claim 1, where step (e) is performed subsequent to step (d).

* * * * *

UNITED STATES PATENT AND TRADEMARK OFFICE

CERTIFICATE OF CORRECTION

PATENT NO. : 4,818,594

DATED : April 4, 1989

INVENTOR(S) : Klaus Albein, et al.

It is certified that error appears in the above-identified patent and that said Letters Patent is hereby corrected as shown below:

Col. 5, line 37 — after "spinnable" delete "polymerric" and insert -- polymeric --.

Col. 6, line 15 — after "said" delete "polymifde" and insert -- polyamide --.

Abstract, line 2: — after "producing" delete "theme" and insert -- them --.

Signed and Sealed this

Fifth Day of December, 1989

*Attest:*

JEFFREY M. SAMUELS

*Attesting Officer* — *Acting Commissioner of Patents and Trademarks*